US006550079B2

(12) United States Patent
Gransow et al.

(10) Patent No.: US 6,550,079 B2
(45) Date of Patent: Apr. 22, 2003

(54) WALL-MOUNT ADJUSTABLE BATH HAND SHOWER

(75) Inventors: Eckhard Gransow, Fröndenberg (DE); Hans Lobermeier, Menden (DE); Bernd Bischoff, Hemer (DE); Hans-Peter Strelow, Freiburg (DE); Sascha Körfer, Hemer (DE); Holger Ellerbrock, Unna (DE); Andreas Kirchhoff, Wickede (DE); Thomas Raadts, Fröndenberg (DE); Joachim Störk, Kippenheim (DE); Hans-Jürgen Linde, Coburg (DE); Uwe Neumann, Bamberg (DE); Andreas Rehklau, Coburg (DE)

(73) Assignee: Friedrich Grohe AG & Co. KG, Hemer (DE)

( * ) Notice: Subject to any disclaimer, the term of this patent is extended or adjusted under 35 U.S.C. 154(b) by 0 days.

(21) Appl. No.: 10/081,427

(22) Filed: Feb. 21, 2002

(65) Prior Publication Data

US 2002/0116757 A1 Aug. 29, 2002

(30) Foreign Application Priority Data

Feb. 27, 2001 (DE) ..... 101 09 448

(51) Int. Cl.[7] ..... A47K 3/20; A47K 4/00

(52) U.S. Cl. ..... 4/567; 4/570; 4/615; 239/283; D23/213

(58) Field of Search ..... 4/567–570, 596, 4/601, 605, 615; 239/588, 282, 283; D23/213

(56) References Cited

U.S. PATENT DOCUMENTS

| | | | | | |
|---|---|---|---|---|---|
| 3,616,466 | A | * | 11/1971 | Davis | 4/615 |
| 4,303,201 | A | * | 12/1981 | Elkins et al. | 4/596 |
| 4,914,759 | A | * | 4/1990 | Goff | 239/283 |
| 5,230,106 | A | * | 7/1993 | Henkin et al. | 4/615 |
| 5,307,528 | A | * | 5/1994 | Nieuwenhuis et al. | 4/605 |
| D384,129 | S | * | 9/1997 | Neufeld et al. | D23/213 |
| 5,857,225 | A | * | 1/1999 | Bischoff et al. | 4/605 |
| 6,256,808 | B1 | * | 7/2001 | Graham et al. | 4/567 |

* cited by examiner

*Primary Examiner*—Gregory Huson
*Assistant Examiner*—Tuan Nguyen
(74) *Attorney, Agent, or Firm*—Herbert Dubno; Andrew Wilford

(57) ABSTRACT

A shower has an elongated C-section holder tube having a laterally open full-length slot open at both ends, a bracket securing the holder tube to the wall, and a shower head. The head has a guide part snugly engageable in and slidable along the holder tube, a narrow neck projecting laterally from the guide part out of the tube through the slot thereof, and a spray part provided with spray holes and mounted on the neck outside the tube. A hose has an inner end connected to the guide part and communicating therethrough with the spray part and an outer end connectable to a source of water under pressure for spraying water from the holes of the spray part. The head is slidable along the holder tube with the hose extending from the guide part inside the holder tube and out of the open end of the holder tube.

10 Claims, 3 Drawing Sheets

Fig. 2
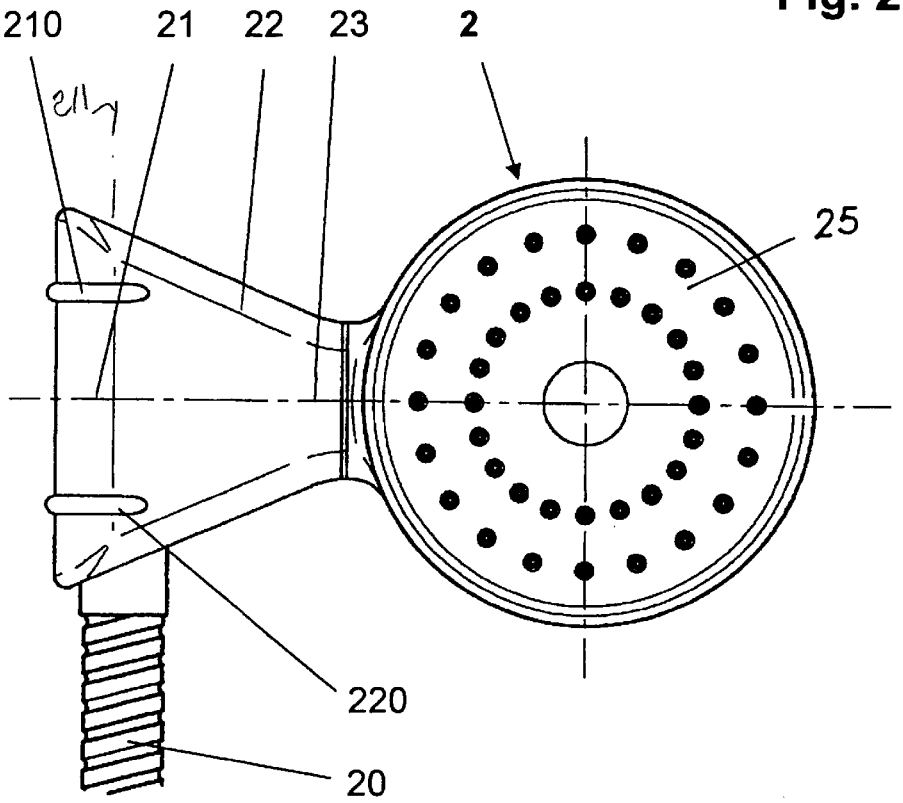
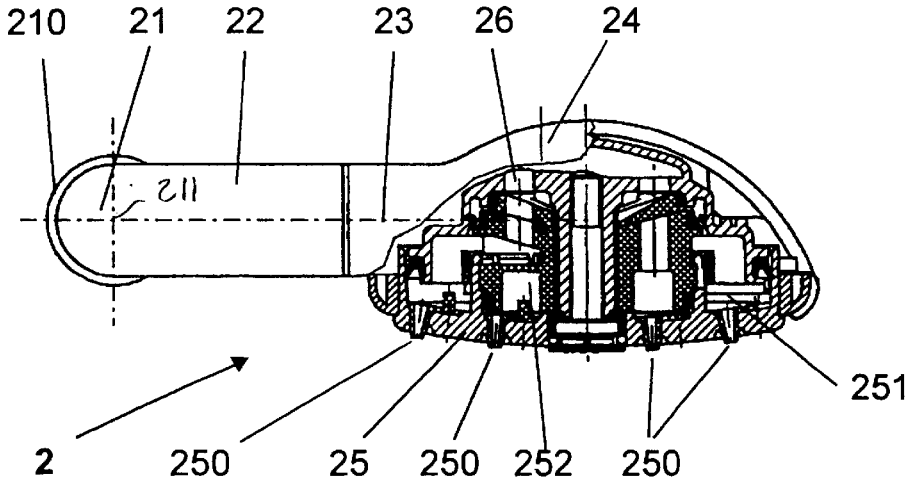
Fig. 3

Fig. 5
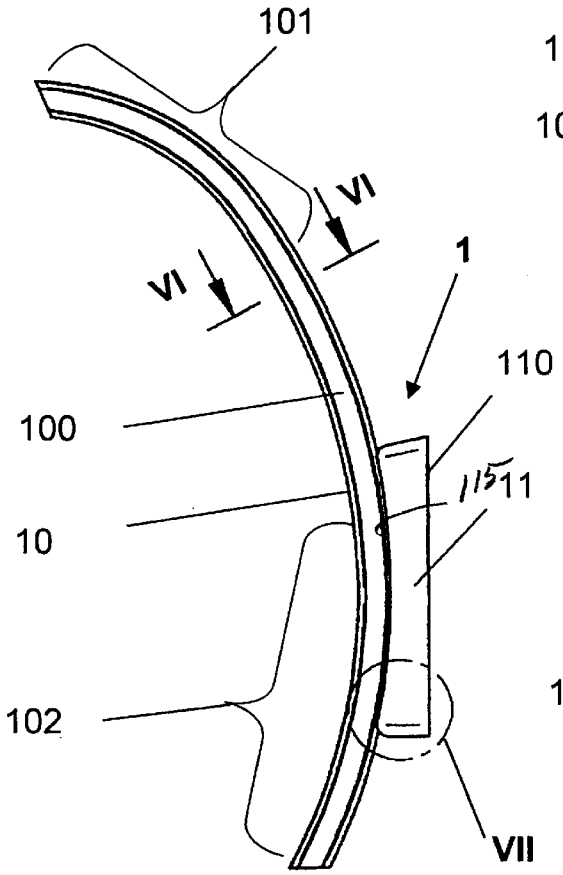
Fig. 4
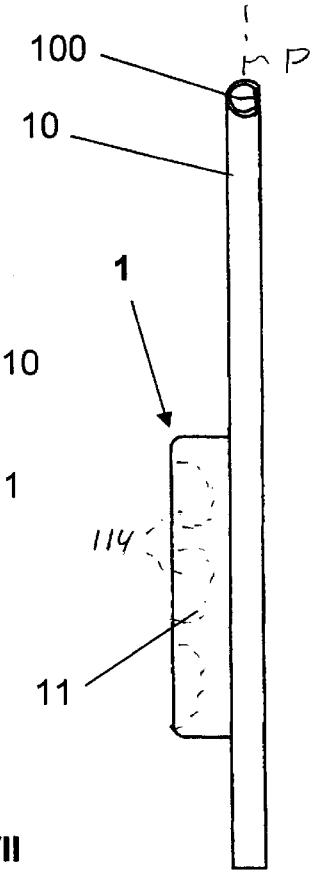
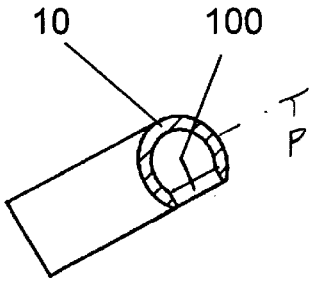
Fig. 6
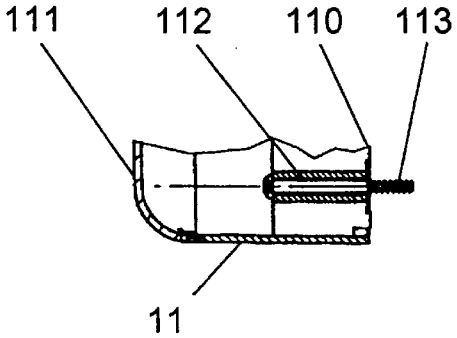
Fig. 7

WALL-MOUNT ADJUSTABLE BATH HAND SHOWER

FIELD OF THE INVENTION

The present invention relates to a shower. More particularly this invention concerns a wall-mount adjustable bath shower.

BACKGROUND OF THE INVENTION

A standard wall-mount hand shower as described in German utility model 2,684,920 has an arcuate tubular holder mounted on the wall. A shower head is mounted at the outer end of a hose that passes through the tubular holder and whose inner end is attached to the water source. Thus the user can leave the shower head in the holder and use the shower as a stationary wall- or deck-mount shower. Alternately the user can pull the shower head up out of the holder to use it as a directed hand shower. Such a unit is typically used in a beauty salon or the like for shampooing and is not normally considered practical for a body shower due to the limited ability to change the position of the shower head in the holder.

In another standard system an upright rod is mounted on the shower-stall or bath wall and a holder is provided that can be secured anywhere along the rod and that has a socket in which a base of a shower head fits. The holder itself can be pivoted on the rod to vary the angle of the shower head. Thus the shower can be used stationary, that is with the holder fixed at a desired level and at a desired angle on the rod, or as a movable hand shower. This system is relatively complex and the trailing hose can get in the way of the bather.

OBJECTS OF THE INVENTION

It is therefore an object of the present invention to provide an improved wall-mount adjustable hand shower.

Another object is the provision of such an improved wall-mount adjustable hand shower which overcomes the above-given disadvantages, that is which can be used both as a stationary or hand shower and that is of simple construction.

A further object is to provide such a shower where the hose feeding the shower head is maintained out of the way at least when the shower is being used with the head in the holder.

SUMMARY OF THE INVENTION

A shower has according to the invention an elongated C-section holder tube normally made of a rigid plastic and having a laterally open full-length slot open at at least one end of the tube, a bracket securing the holder tube to the wall with the slot open generally parallel to the wall, and a shower head. The head has a guide part snugly engageable in and slidable longitudinally along the holder tube, a narrow neck projecting laterally from the guide part out of the tube through the slot thereof, and a spray part provided with spray holes and mounted on the neck outside the tube. A flexible hose has an inner end connected to the guide part and communicating therethrough with the spray part and an outer end connectable to a source of water under pressure for spraying water from the holes of the spray part. The shower head is slidable along the holder tube with the hose extending from the guide part inside the holder tube and out of the open end of the holder tube. The slot in accordance with the invention is open at a lower end of the tube and the head is displaceable wholly out of the tube at the open lower tube end.

Thus with this system the actual shower head can be used as a standard hand or fist shower, that is with the user holding it in one hand and directing the spray wherever he or she wants and the flexible supply hose being the only connection to the wall. Alternately the shower head can be fitted to the holder tube and can be slid therealong to any desired position, directing spray vertically downward from above for a standard athletic shower or outward from the side when the user wants to bathe without wetting his or her hair, or even lower as for instance to clean the legs and feet after gardening. Whenever the spray head is in the holder, the hose is pulled at least partially into the holder tube so that at least part of it is moved completely out of the bather's way. When the shower head is in the upper portion of the holder, only a small loop of hose extends from the lower holder end to the water supply.

According to the invention the holder tube is arcuate in a plane and the slot opens parallel to the plane. This plane is normally perpendicular to the wall. More particularly the holder tube has an upper portion of a smaller radius of curvature than a lower part of the tube. This allows the spray to be oriented almost vertically downward or from the side as described above.

The holder is fixed to the wall by a bracket itself fixable to the wall. When the tube is arcuate the bracket has a front side with an arcuate seat holding the tube and a flat back side engaging the wall. Screws fix the bracket to the wall. The bracket has a removable cover normally covering the screws and giving the mounting bracket a sleek, finished look. This bracket can be provided with seats or holders for alternate spray plates for the shower head, allowing the user to alter the spray pattern.

The guide part according to the invention is formed with a pair of spaced-apart part-circular ridges and the tube is of generally circular section. Furthermore the spray part is pivotal about an axis on the neck, has two arrays of the holes, and is provided with a valve for directing water to the arrays alternately.

BRIEF DESCRIPTION OF THE DRAWING

The above and other objects, features, and advantages will become more readily apparent from the following description, reference being made to the accompanying drawing in which:

FIG. 2 is a front view of the shower head in accordance with the invention;

FIG. 3 is a partly sectional side view of the shower head;

FIG. 4 is a front view of the wall-mount support tube and mounting bracket according to the invention;

FIG. 5 is a side view of the support tube and mounting bracket;

FIG. 6 is a section taken along line VI—VI of FIG. 5; and

FIG. 7 is a partly sectional large-scale view of the detail indicated at VII in FIG. 5.

SPECIFIC DESCRIPTION

Figure 1:
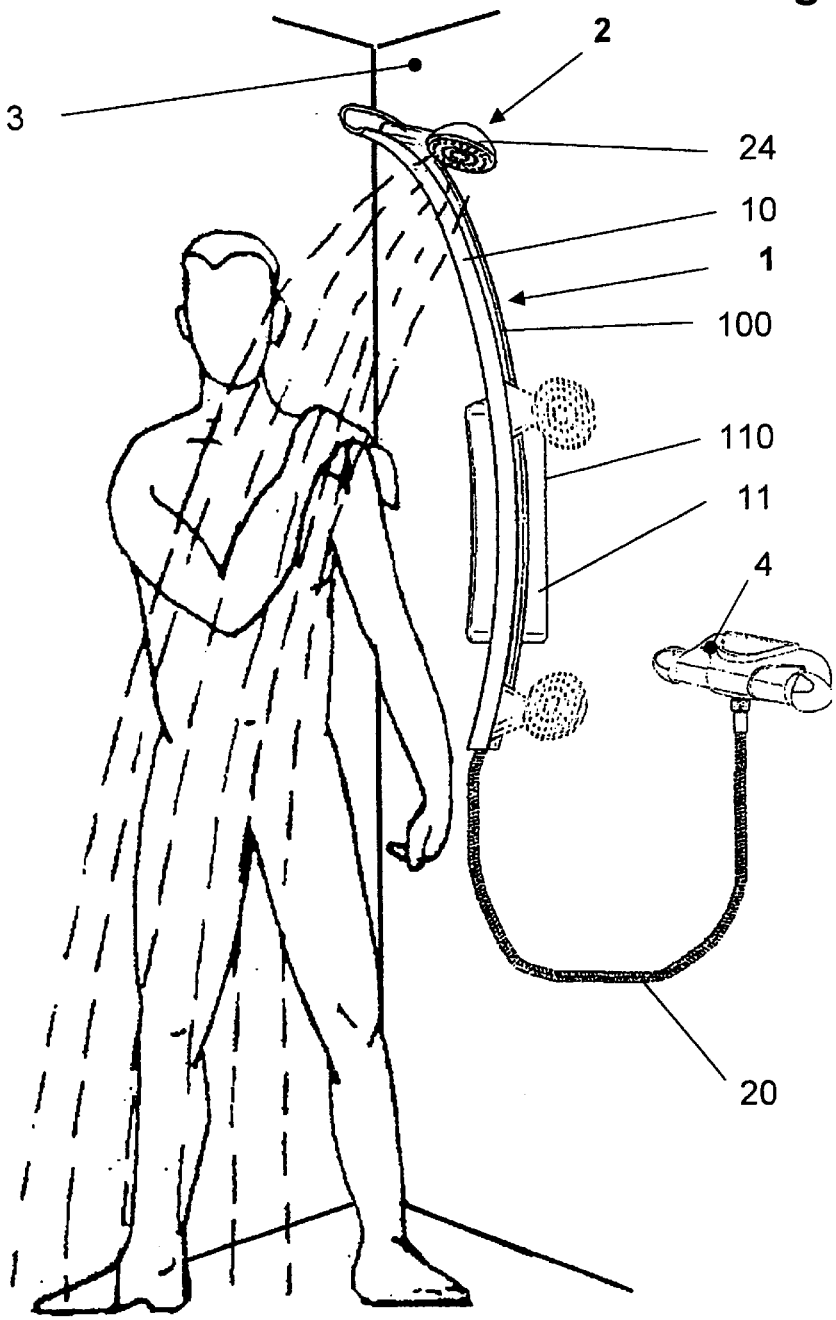
FIG. 1 is a small-scale perspective view illustrating the shower according to the invention.

As seen in FIG. 1 the shower according to the invention basically comprises a holder 1 carrying a shower head 2 and mounted on a wall 3. A hose 20 extends along the holder 1 to a water-supply faucet 4 also mounted on the wall 3. The holder 1 extends from a location at about a bather's waist to well above the bather's head and the shower head 2 can be positioned stably anywhere along the entire length of the holder 1.

FIGS. 2 and 3 show how the shower head 2 has a guide part 21 slidable along the holder 1 and unitarily formed of molded plastic with a pair of part-circular guide ridges 210 and 220 centered on an axis 211. A flat triangular neck 22 extends outward from the guide part 21 along an axis 23 perpendicular to the axis 211 and tapers outward to an outer end on which a spray part 24 is mounted so as to be pivotal about the axis 23 relative to the unitary neck 22 and guide 21. The spray part 24 has a face plate 25 provided with an array of spray nozzles 250 arranged in two rings and communicating with respective chambers 251 and 252 that can alternately or both be fed water by a pivot valve 26 of standard construction. The connection between the spray part 24 and the neck 22 is such that pressurized water in the hose 20 passes from the guide part 21 through the neck 22 and into the spray part 24 and thence is fed by the valve 26 to the chamber 251 and/or 252.

The holder 1 comprises an arcuate C-section tube 10 lying in a vertical plane P and having a full-length slot 100 open perpendicular to this plane P and at both the upper and lower ends of the tube 10. Normally the guide ridges 210 and 220 fit complementarily inside the tube 10 and the thin neck 22 extends outward therefrom through the slot 100. The tube 10 is attached to the wall at a forwardly arcuate seat 115 of a bracket 11 and is somewhat longer and curved to a somewhat smaller radius above the bracket 11 than below it. The hose 20 extends out of the open lower end of the tube 10.

The bracket 11 has opposite the arcuate seat 115 a planar rear face 110 that fits against the wall 3 and is formed with holes 112 through which screws 113 engage to anchor it to the wall 3. A snap-off cover 111 normally conceals and protects the heads of the anchor screws 113.

The spray part 24 can be set up to provide different sprays, even pulsing sprays. It can have removable face plates 25 and spares or face plates with different spray configurations can be held in pockets or seats 114 in the bracket 11.

The shower head 2 is of the fist type, that is it has in effect no handle and the spray part 24 itself is intended to be held in the hand. When thus held it is possible to use the system as a standard hand shower, free of the holder 1.

For stationary use the head 2 is slid into the open lower end of the support tube 10 with the hose 20 running out the bottom and the neck 22 projecting through the slot 100. In this position it is possible to slide the head 2 along the tube 10. The guide ridges 210 and 220 are dimensioned such that they fit tightly and prevent unintentional sliding of the head 2 in the holder 1.

Thus it is possible to position the shower head 2 in the upper solid-line position for full-body and head showering. If it is moved down the upper dashed-line position the bather can wash without getting his or her hair wet, and if only the lower body needs washing, it can be slid to the lower dashed-line position. In any of these positions the spray part 24 can be pivoted about the axis 23 to change the angle of the spray streams issuing from the nozzles 250.

We claim:

1. A shower adapted to be mounted on a vertical wall and comprising:

an elongated C-section holder tube lying generally in a vertical plane generally perpendicular to the wall and having a laterally open full-length slot open generally perpendicular to the plane and at at least one end of the tube;

means for securing the holder tube to the wall with the slot open generally parallel to the wall;

a shower head having a guide part snugly engageable in and slidable longitudinally along the holder tube, a narrow neck projecting laterally from the guide part out of the tube through the slot thereof, and a spray part provided with spray holes, pivotal on the neck about an axis generally perpendicular to the plane, and mounted on the neck outside the tube; and a flexible hose having an inner end connected to the guide part and communicating therethrough with the spray part and an outer end connectable to a source of water under pressure for spraying water from the holes of the spray part, the shower-head guide part being slidable along the holder tube with the hose extending from the guide part inside the holder tube and out of the open end of the holder tube.

2. The shower defined in claim 1 wherein the holder tube has an upper portion of a smaller radius of curvature than a lower part of the tube.

3. The shower defined in claim 1 wherein the slot is open at a lower end of the tube and the head is displaceable wholly out of the tube at the open lower tube end.

4. The shower defined in claim 1 wherein the means is a bracket fixed to the tube and fixable to the wall.

5. The shower defined in claim 4 wherein the tube is arcuate and the bracket has a front side with an arcuate seat holding the tube and a flat back side engaging the wall.

6. The shower defined in claim 4 wherein the means includes screws fixing the bracket to the wall, the bracket having a removable cover normally covering the screws.

7. The shower defined in claim 4 wherein the spray part has a removable spray plate formed with spray holes and the bracket is formed with a pocket in which the plate can fit for storage.

8. The shower defined in claim 1 wherein the guide part is formed with a pair of spaced-apart part-circular ridges and the tube is of generally circular section.

9. The shower defined in claim 1 wherein the spray part has two arrays of the holes and is provided with a valve for directing water to the arrays alternately.

10. A shower comprising:

an elongated C-section holder tube having a laterally open full-length slot open at at least one end of the tube;

means including a bracket fixed to the tube and fixable to a wall for securing the holder tube to the wall with the slot open generally parallel to the wall;

a shower head having a guide part snugly engageable in and slidable longitudinally along the holder tube, a narrow neck projecting laterally from the guide part out of the tube through the slot thereof, and a spray part provided with spray holes, having a removable spray plate, and mounted on the neck outside the tube, the bracket being formed with a pocket in which the plate can fit for storage; and a flexible hose having an inner end connected to the guide part and communicating therethrough with the spray part and an outer end connectable to a source of water under pressure for spraying water from the holes of the spray part, the shower-head guide part being slidable along the holder tube with the hose extending from the guide part inside the holder tube and out of the open end of the holder tube.

* * * * *